United States Patent [19]

Provence

[11] Patent Number: 4,945,658

[45] Date of Patent: Aug. 7, 1990

[54] CROSS-COUNTRY SHOE

[75] Inventor: Marc Provence, Thorenes-les-Glieres, France

[73] Assignee: Salomon S.A., Annecy Cedex, France

[21] Appl. No.: 359,456

[22] Filed: May 31, 1989

[30] Foreign Application Priority Data

May 31, 1988 [FR] France ..... 88 07225

[51] Int. Cl.[5] ..... A43B 5/04

[52] U.S. Cl. ..... 36/117; 36/125; 280/615

[58] Field of Search ..... 36/117, 120, 125; 280/615

[56] References Cited

U.S. PATENT DOCUMENTS

| | | | |
|---|---|---|---|
| 4,514,916 | 5/1985 | Aarflot | 36/117 |
| 4,714,267 | 12/1987 | Abondance et al. | 280/615 |
| 4,789,177 | 12/1988 | Graillat | 280/615 X |
| 4,842,293 | 6/1989 | Rochard | 280/615 |

FOREIGN PATENT DOCUMENTS

| | | | |
|---|---|---|---|
| 3633100 | 9/1986 | Fed. Rep. of Germany | 36/117 |

*Primary Examiner*—Paul T. Sewell
*Assistant Examiner*—Andrew D. Meyers
*Attorney, Agent, or Firm*—Pollock, Vande Sande & Priddy

[57] ABSTRACT

A cross-country ski boot comprising a sole (2) made of a molded plastic material, having a longitudinal groove (2*a*) by means of which it covers a longitudinal rib (3*a*) provided on the upper surface of the ski (3), when the boot is flat on the ski. The boot comprises, at least in the area of its heel (4), a shaped, rigid reinforcing element (5) which shapes itself so as to fit the transverse profile of the groove (2*a*) of the sole (2) and which is embedded at least partially in the plastic material of the sole (2), and this reinforcing element (5) carries walking and/or wear-resistant runners (6) which are mounted on its surfaces (5*b*, 5*c*) which come to rest for support on corresponding surfaces (3*c*, 3*d*; 3*e*, 3*f*) of the ski.

32 Claims, 3 Drawing Sheets

CROSS-COUNTRY SHOE

FIELD OF THE INVENTION

The present invention concerns a cross-country ski boot.

BACKGROUND OF THE INVENTION

As described in particular in Patents N°s FR-A-2 443 853, FR-A-2 387 062, and AT-368 368, cross-country ski boots are already well known in which the soles, made of a molded plastic material, have hollow and/or raised parts intended to cooperate with corresponding raised and/or hollow parts on the upper surface of a cross-country ski. One especially well-known ski boot has a sole equipped with a central longitudinal groove which cooperates with a longitudinal rib on the upper surface of the ski in order to provide lateral control of the boot when the skier's foot is spread out flat on the ski. By virtue of their design, the soles of cross-country boots of this kind make contact with the raised and/or hollow parts of the cross-country ski in circumscribed areas where the frictional forces are concentrated, and, in these circumscribed areas, the soles show a substantially-reduced resistance to wear. This wearing phenomenon is especially pronounced in the area providing support for the heel, which is alternately raised and lowered during cross-country skiing, and which thus comes into periodic contact with the ski.

SUMMARY OF THE INVENTION

The aim of the present invention is to solve these problems simply and effectively by increasing the resistance to wear of the heel of the boot, without changing the static stable positioning of the foot.

For this purpose, this cross-country ski boot comprises a sole made of a molded plastic material having a longitudinal groove by means of which, when the boot is flattened out on the ski, the sole covers a longitudinal rib placed on the upper surface of the ski, this sole being characterized by the fact that it comprises, at least in the area of its heel, a shaped rigid reinforcing element which molds itself to the transverse shape of the groove of the sole and which is embedded at least partially in the plastic material of the sole, and by the fact that this reinforcing element carries walking and/or wearresistance runners which are mounted on the surfaces of the element resting for support on the corresponding surfaces of the ski.

BRIEF DESCRIPTION OF THE DRAWINGS

Several embodiments of the invention, provided as by way of example will be described below with reference to the attached drawings, in which.

DESCRIPTION OF THE PREFERRED EMBODIMENTS

Figure 9:
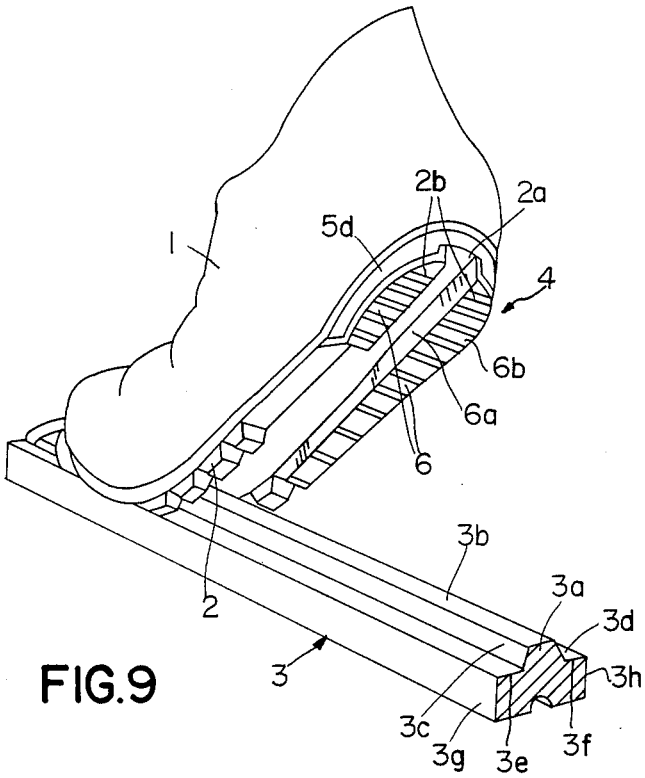
FIG. 9 is a perspective view of a boot according to the invention mounted on a shaped ski having an upper longitudinal rib, the heel of the boot being shown in a raised position.

The cross-country ski boot illustrated in the drawings comprises an upper 1 and a sole 2 made of a molded plastic material. This boot is designed to be attached by its forward tip to a cross-country ski 3 (FIG. 9) having a shaped, transverse section. This cross-country ski 3 has, more especially, on its upper surface a longitudinal rib 3*a* having, for example, the form of an isosceles trapezoid, which is delimited by a horizontal upper surface 3*b* making up the short base of the trapezoid rib and two sloping sides 3*c*, 3*d*. These two sides are, in turn, connected by horizontal rims 3*e* and 3*f* to the two lateral, vertical edges 3*g* and 3*h* of the ski 3. For its part, the sole 2 is shaped so as to have in its central portion a longitudinal groove 2*a*, trapezoidal in shape, which is designed to contain the longitudinal groove 3*a* of the ski 3 during cross-country skiing when the boot is extended so as to be flat on the ski. Thus, the longitudinal groove 2*a* delimits two lateral projecting parts 2*b* in the area of the heel 4.

Figure 2:
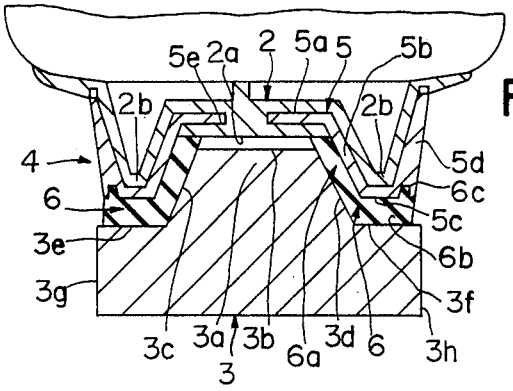
FIG. 2 is a larger-scale vertical and transverse cross-section view along the line II—II in FIG. 1.
Figure 3:
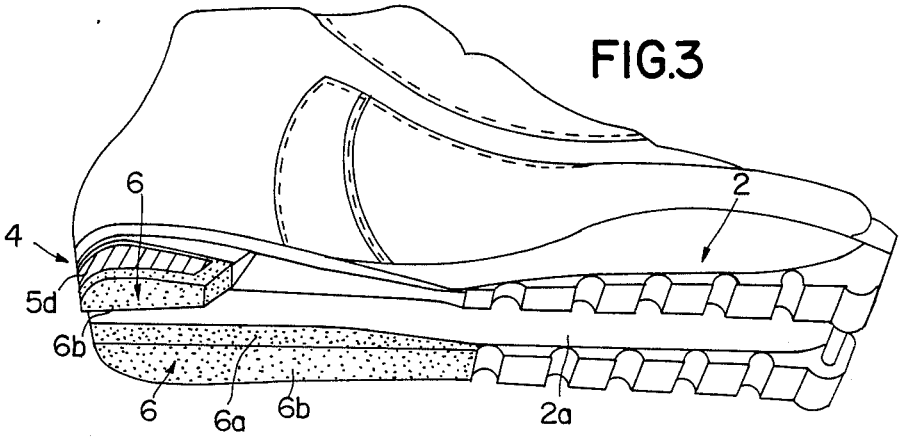
FIG. 3 is a perspective view taken from below of the cross-country ski boot according to FIG. 1.
Figure 4:
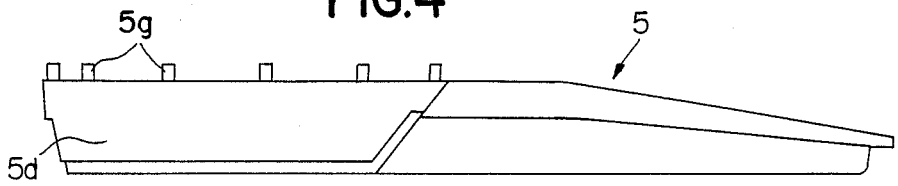
FIG. 4 is an elevation view of the reinforcing element incorporated in the sole of the boot.

In accordance with the invention, the sole 2 of the boot comprises, in its rear portion and at least in the area of the heel 4, a rigid reinforcing element 5 which is at least partially embedded in the plastic material making up the sole 2. More precisely, this reinforcing element 5, which is, advantageously, made of a molded rigid plastic material, comprises, as can be best seen in FIG. 2, a central core 5*a* totally embedded in the plastic material making up the sole 2 and extending above the groove 2*a* of this sole. This central core 5*a* is extended downward and outward on each longitudinal side by an internal sloping side 5*b*, in such a way that the core 5*a* and the sloping sides 5*b* together make up a transverse section profile in the shape of a trapezoid having a short upper base. Each sloping side 5*b* is, in turn, extended outward by a lower, horizontal wing 5*c* possessing slight width, which is, in turn, extended upward by an external wing 5*d*. As shown in FIG. 2, the sloping side 5*b*, the lower horizontal wing 5*c*, and the external wing 5*d* are mounted beneath the corresponding parts of identical shape on the sole 2*a*. However, in accordance with a variant, these parts could also be embedded in the plastic material of the sole 2 at these points. Each external wing 5*d* may be vertical, or it may, preferably, extend in sloping fashion from the inside outward and downward.

Figure 5:
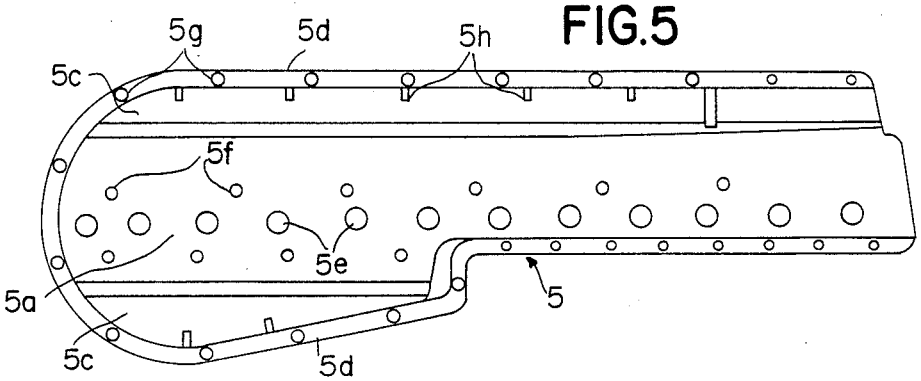
FIG. 5 is a plan view of the reinforcing element.
Figure 6:
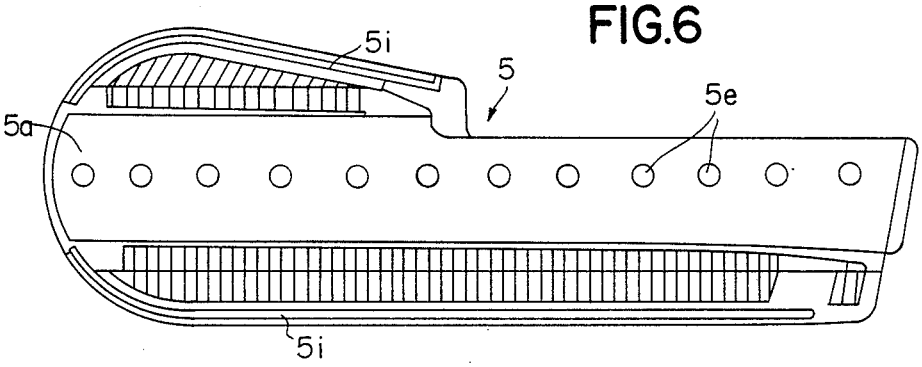
FIG. 6 is a bottom plan view of the reinforcing element.
Figure 7:
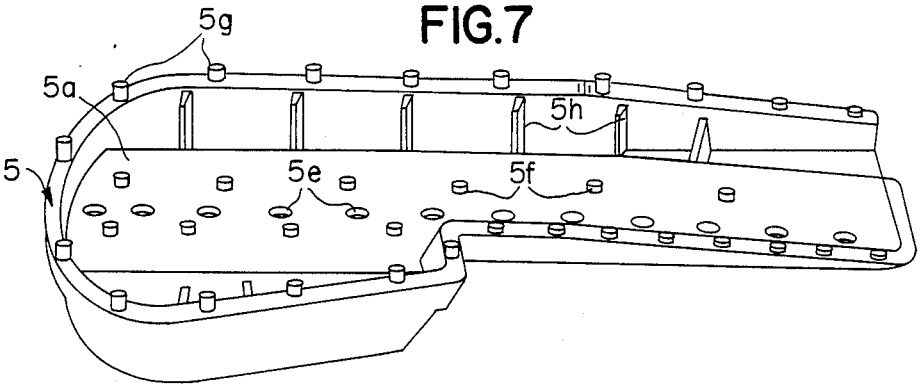
FIG. 7 is a perspective, overhead view of the reinforcing element incorporated into the sole of the boot.

The central core 5*a* of the reinforcing element 5 may be continuous or, in accordance with a variant, it may be drilled with holes 5*e* spaced apart and aligned longitudinally, as may be better observed in FIGS. 5 to 7, these holes being filled with the plastic material of the sole 2 after molding, thereby improving the anchoring of the reinforcing element 5 in the sole 2. This anchoring may also be strengthened by means of points 5*f* produced in the molding which are spaced out longitudinally on the core 5*a* and extend upward. Each external wing 5*d* may also be provided with spaced anchoring points 5*g* arranged laterally along its upper edge.

The stiffness of the reinforcing element can be increased by providing, on the inner surfaces of the external wings 5*d*, stiffening ribs 5*h* extending vertically and spaced apart in the longitudinal direction.

The reinforcing element 5 carries, furthermore, on each longitudinal side, a wear-resistant and/or walking runner 6. This runner 6 fits the shape of the inner sloping side 5*b* and of the horizontal wing 5*c* beneath which it is attached. This attachment may, advantageously, be produced by gluing the runner 6 to the reinforcing element 5. The adhesion may be improved horizontal wings 5*c* with rough surfaces, for example ridges. Each runner 6 comprises an inner sloping wing 6*a* which is interposed between the sloping side 3*c*, 3*d* of the rib 3*a* of the ski 3 and the inner sloping side 5*b* of the reinforcing element 5, as well as a lower horizontal wing 6*b* extending between the lower horizontal wing 5*c* of the reinforcing element 5 and the corresponding horizontal rim 3*e*, 3*f* of the ski 3. Each runner 6 is attached to the reinforcing element 5 by any appropriate means, and this attachment may be strengthened by the anchoring of a rib 6*c* provided on the runner 6 (or the reinforcing element 5) along its edge, this rib being engaged in a groove 5*i* formed in the reinforcing element 5 (or the runner 6).

Figure 8:
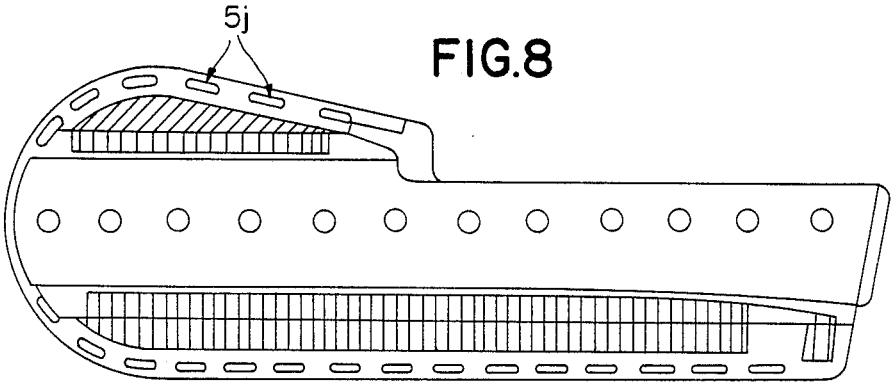
FIG. 8 is a bottom plan view of another embodiment of the reinforcing element.

According to one variant, illustrated in FIG. 8, the grooves 5*i* of the reinforcing element 5 are replaced by a succession of recesses 5*j*, in which the corresponding points emanating from the runners 6 are inserted.

It may be observed, according to the preceding description, that the reinforcing element 5 is visible on the outside of the sole 2 on the two outer lateral sides of the two rear projections 2*b* extending downward, which are delimited by the central groove 2*a* in the area of the heel 4. The reinforcing element 5 may cover the rear extremity on each of the projections 2*b*. However, in the embodiment shown in the drawing, this rear extremity is covered by a portion 6*d* of the walking and/or wear-resistant runner 6 which runs upward and rearward.

Figure 1:
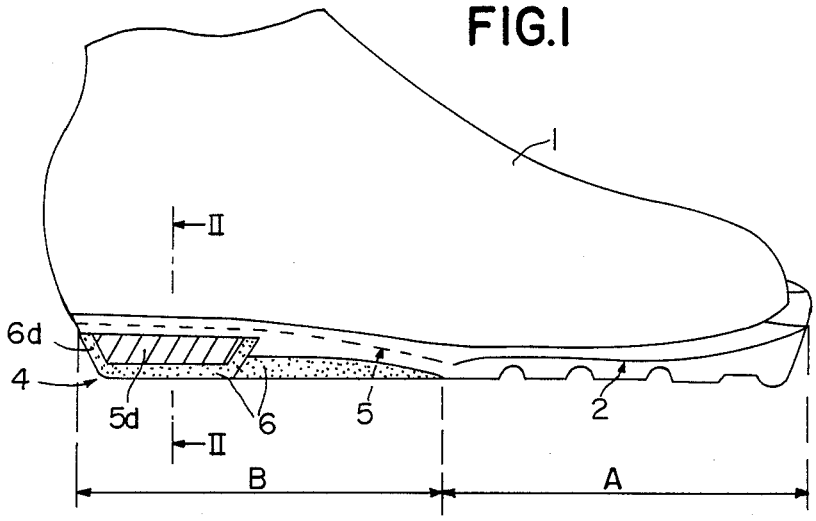
FIG. 1 is an elevation view of a cross-country ski boot according to the invention.

The vertical, transverse section of the reinforcing element 5, which has an approximate W shape, as can be seen in FIG. 2, has a profile which decreases toward the front of the boot, that is, its height decreases progressively and this reinforcing element stops at about the middle of the sole 2, that is, at the beginning of the area of plantar support. The sole 2 is this subdivided into two parts, a flexible front part corresponding to area A in FIG. 1 and extending from the front end of the boot to the front end of the reinforcing element 5, and a rigid rear part B extending from the end of the reinforcing element 5 to the rear of the heel 4.

The reinforcing element 5 extends dissymmetrically in the longitudinal direction on both sides of the boot. FIGS. 1 to 7, which illustrate a left boot, show that the lower horizontal wing 5*c* and the corresponding outer wing 5*d* of the reinforcing element 5, which are located on the left side of the boot, i.e., on the outer side, are longer than the corresponding wings located on the right, or inner, side of the boot, and they extend substantially up to the beginning of the plantar support area, thus substantially over the half of the sole length corresponding to the rigid rear area B. On the other hand, the wings 5*c*, 5*d* of the reinforcing element 5, which are located on the inner side, i.e., on the right side of the left boot shown in FIGS. 1 to 7, extend substantially only over the length of the heel 4, that is, they stop before reaching the beginning of the arch. This construction results from the fact that, in an optimal median position of the foot on the ski 3, the boot 2 has a natural overhang which is more sizable on the outer edge, and from the fact that it would be necessary to fill in uselessly the area corresponding to the area of the arch, in order to produce a symmetrical reinforcing element 5 extending to the front of the foot.

What is claimed is:

1. Cross-country ski boot comprising a sole (2) made of a molded plastic material having a longitudinal groove (2*a*), wherein said sole comprises, at least in a heel area (4) of said sole, a rigid reinforcing element (5) shaped to conform to a transverse profile of said groove (2*a*) of said sole (2) and embedded at least in part in the plastic material of the said sole (2), and wherein said reinforcing element (5) carries walking runners (6) mounted one element surfaces (5*b*, 5*c*) of said reinforcing element.

2. Cross-country ski boot according to claim 1, in combination with a cross-country ski (3) having on an upper surface of said ski a longitudinal rib (3*a*) which is covered by said longitudinal groove (2*a*) when said boot unrolls flat on said ski and said element surfaces (5*b*, 5*c*) rest for support on corresponding surfaces (3*c*, 3*d*; 3*e*, 3*f*) of said ski.

3. Cross-country ski boot according to claim 2, wherein said reinforcing element (5) comprises a central core (5*a*) which is completely embedded in said plastic material and extends above said groove (2*a*) of said sole (2), said central core (5*a*) being extended downward and outward on each longitudinal side by a sloping edge (5*b*), such that said core (5*a*) and said sloping edges (5*b*) jointly constitute a transverse sectional profile in the shape of a trapezoid having an upper short base, and each sloping edge (5*b*) being extended outward by a horizontal wing (5*c*) of slight width, each said edge being, in turn, extended upward by an outer wing (5*d*).

4. Cross-country ski boot according to claim 3, wherein said central core (5*a*) of said reinforcing element (5) is continuous.

5. Cross-country ski boot according to claim 3, wherein said central core (5*a*) of said reinforcing element (5) is perforated by spaced, longitudinally aligned holes (5*e*) filled with plastic material of said sole (2) after molding.

6. Cross-country ski boot according to claim 3, wherein said central core (5*a*) is provided with molded anchoring points (5*f*).

7. Cross-country ski boot according to claim 3, wherein each walking runner (6) conforms to the shape of the inner sloping edge (5*b*) and of the horizontal wing (5*c*) beneath which it is attached.

8. Cross-country ski boot according to claim 7, wherein each runner (6) comprises an inner sloping wing (6*a*), interposed between a sloping edge (3*c*, 3*d*) of said rib (3*a*) of said ski (3) and said sloping edge (5*b*) of said reinforcing element (5), and a lower horizontal wing (6*b*) extending between the lower horizontal wing (5*c*) of said reinforcing element (5) and a corresponding horizontal rim (3*e*, 3*f*) of said ski (3).

9. Cross-country ski boot according to claim 1, wherein each runner (6) is attached to said reinforcing element (5) by means of the anchoring of a rib (6*c*) provided on said runner (6) and inserted in a groove (5*i*) of said reinforcing element (5).

10. Cross-country ski boot according to claim 1, wherein each reinforcing element (5) is attached to said runner (6) by means of the anchoring of a rib (6*c*) provided on said reinforcing element (5) and inserted in a groove (5*i*) of said runner (6).

11. Cross-country ski boot according to claim 1, wherein each runner (6) is attached to said reinforcing element (5) by means of the anchoring of points provided on said runner (6) and inserted in spaced holes of said reinforcing element (5).

12. Cross-country ski boot according to claim 1, wherein each reinforcing element (5) is attached to said runner (6) by means of the anchoring of points provided on said reinforcing element (5) and inserted in spaced holes of said runner (6).

13. Cross-country ski boot according to claim 1, wherein said reinforcing element (5) comprises molded spaced points (5*g*) along its upper edge.

14. Cross-country ski boot according to claim 1, wherein said reinforcing element (5) comprises molded stiffening ribs (5*h*) along an inner surface of its outer wings (5*d*).

15. Cross-country ski boot according to claim 1, wherein a vertical transverse section of said reinforcing element (5) is approximately W-shaped and has a profile which decreases in the direction toward a front of said boot, its height decreasing progressively, and wherein said reinforcing element (5) stops at about the middle of said sole (2).

16. Cross-country ski boot according to claim 1, wherein said reinforcing element (5) extends longitudinally in dissymmetrical fashion on both sides of said boot, a part of said reinforcing element (5) on an outer side of said boot being longer than a part of said reinforcing element no an inner side of said boot.

17. Cross-country ski boot according to claim 16, wherein said lower horizontal wing (5*c*) and said corresponding outer wing (5*d*) of said reinforcing element (5), located on an outer side, extend substantially up to the beginning of a plantar support area, while said wings (5*c*, 5*d*) of said reinforcing element (5) located on an inner side extend substantially over the length of said heel (4), stopping before reaching the beginning of a plantar arch.

18. A rigid reinforcing element (5) adapted for insertion in a boot sole made of plastic material and having a longitudinal groove (2*a*) therein, said reinforcing element comprising a central core (5*a*) extended downward and outward on each longitudinal side by a sloping edge (5*b*), such that said core (5*a*) and said sloping edges (5*b*) jointly constitute a transverse sectional profile in the shape of a trapezoid having an upper short base, and each sloping edge (5*b*) being extended outward by a horizontal wing (5*c*) of slight width, each said being, in turn, extended upward by an outer wing (5*d*).

19. Reinforcing element according to claim 18, wherein said central core (5*a*) is continuous.

20. Reinforcing element according to claim 18, wherein said central core (5*a*) is perforated by spaced, longitudinally aligned holes (5*e*) filled with plastic material of said boot sole (2) after molding.

21. Reinforcing element according to claim 18, wherein said central core (5*a*) is provided with molded anchoring points 22. Reinforcing element according to claim 18, comprising walking runners (6) attached beneath and conforming to the shape of the inner sloping edge (5*b*) and of the horizontal wing (5*c*).

23. Reinforcing element according to claim 22, wherein each runner (6) comprises an inner sloping wing (6*a*), interposed between a sloping edge (3*c*, 3*d*) of said rib (3*a*) of said ski (3) and said sloping edge (5*d*) of said reinforcing element (5), and a lower horizontal wing (6*b*) extending between the lower horizontal wing (5*c*) of said reinforcing element (5) and a corresponding horizontal rim (3*e*, 3*f*) of said ski (3).

24. Reinforcing element according to claim 22, wherein each runner (6) is attached to said reinforcing element (5) by means of anchoring of a rib (6*c*) provided on said runner (6) and inserted in a groove (5*i*) of said reinforcing element (5).

25. Cross-country ski boot according to claim 22, wherein each reinforcing element (5) is attached to said runner (6) by means of anchoring of a rib (6*c*) provided on said reinforcing element (5) of and inserted in a groove (5*i*) of said runner (6).

26. Reinforcing element according to claim 22, wherein each runner (6) is attached to said reinforcing element (5) by means of the anchoring of points provided on said runner (6) and inserted in spaced holes of said reinforcing element (5).

27. Reinforcing element according to claim 22, wherein each reinforcing element (5) is attached to said runner (6) by means of the anchoring of points provided on said reinforcing element (5) and inserted in spaced holes of said runner (6).

28. Reinforcing element according to claim 22, wherein said reinforcing element (5) comprises molded spaced points (5*g*) along its upper edge.

29. Reinforcing element according to claim 22, wherein said reinforcing element (5) comprises molded stiffening ribs (5*h*) along an inner surface of its outer wings (5*d*).

30. Reinforcing element according to claim 22, wherein a vertical transverse section of said reinforcing element (5) is approximately W-shaped and has a profile which decreases in the direction toward a front of said boot, its height decreasing progressively, anD wherein said reinforcing element (5) stops at about the middle of said sole (2).

31. Reinforcing element according to claim 1, wherein said reinforcing element (5) extends longitudinally in dissymmetrical fashion on both sides of said boot, a part of said reinforcing element (5) on an outer side of said boot being longer than a part of said reinforcing element on an inner side of said boot.

32. Reinforcing element according to claim 31, wherein said lower horizontal wing (5*c*) and said corresponding outer wing (5*d*) of said reinforcing element (5), located on an outer side, extend substantially up to the beginning of a plantar support area, while said wings (5*c*, 5*d*) of said reinforcing element (5) located on an inner side extend substantially over the length of said heel (4), stopping before reaching the beginning of a plantar arch.

* * * * *